United States Patent [19]

Schifman

[11] 4,032,152

[45] June 28, 1977

[54] BOARD GAME

[75] Inventor: Edward J. Schifman, Nashville, Tenn.

[73] Assignee: Aladdin Industries, Incorporated, Nashville, Tenn.

[22] Filed: Jan. 23, 1976

[21] Appl. No.: 651,948

[52] U.S. Cl. ..... 273/131 BA; 273/136 K; 273/137 AB; 273/137 AD; 273/137 F

[51] Int. Cl.² ..... A63F 3/02

[58] Field of Search ..... 273/131, 136, 137

[56] References Cited

UNITED STATES PATENTS

| | | | |
|---|---|---|---|
| 1,430,778 | 10/1922 | Williams | 273/136 K UX |
| 3,347,550 | 10/1967 | Carboni | 273/131 BB X |
| 3,568,357 | 3/1971 | Lebensfend | 273/134 AD UX |
| 3,751,039 | 8/1973 | Dykoski | 273/131 AC |

*Primary Examiner*—Delbert B. Lowe
*Attorney, Agent, or Firm*—McDougall, Hersh & Scott

[57] ABSTRACT

Equipment for playing a board game is disclosed. The equipment includes a modified checkerboard having a plurality of apertures therein, two sets of courier pegs adapted to move on the checkerboard and fit into the apertures, and a pair of key markers dimensioned to fit over the courier pegs. Each player has a key marker and the object of the game is to get the key marker from one side of the checkerboard to the other by moving from courier peg to courier peg.

6 Claims, 4 Drawing Figures

BOARD GAME

BACKGROUND OF THE INVENTION

This invention relates to board games. In particular, it relates to board games of the type employing a standard or modified checkerboard in conjunction with a plurality of playing pieces. In the prior art many checker games and variations thereof are known. In these checker games there is provided an eight by eight array of squares, usually of alternating colors, on which checkers are placed. The checkers are usually of opposing colors and the object of the game is to take all the checkers from one side before the opponent achieves the same objective. The usual checker marker is a solid cylindrical shape. When a checker marker reaches the far end of the board, it is kinged and permitted additional degrees of movement.

One variation of the standard checkers game which employs markers of a different shape is disclosed in U.S. Pat. No. 3,347,550. In that game a checkerboard is employed in conjunction with a map of the United States having a number of apertures therethrough, usually one to each state. The checker markers serve the dual purpose of playing the regular game of checkers and upon being jumped they are placed on the map in the appropriate state location designated on the checker. In that patent a king is designated by the placement of a hollow cylindrical element over the checker marker. Other games which employ unusual markers are disclosed in U.S. Pat. Nos. 2,896,950 and 2,751,228. In both of the latter patents it is noted that these markers are not used in conjunction with a checkerboard.

It is an object of the present invention to provide a new and unobvious variation of the checker game.

It is another object of the present invention to provide a board game in which a key marker must be moved from one side of the board to the other over the courier pegs.

Other objects and advantages of the invention will become apparent from the remaining portion of the specification.

DETAILED DESCRIPTION

Figure 1:
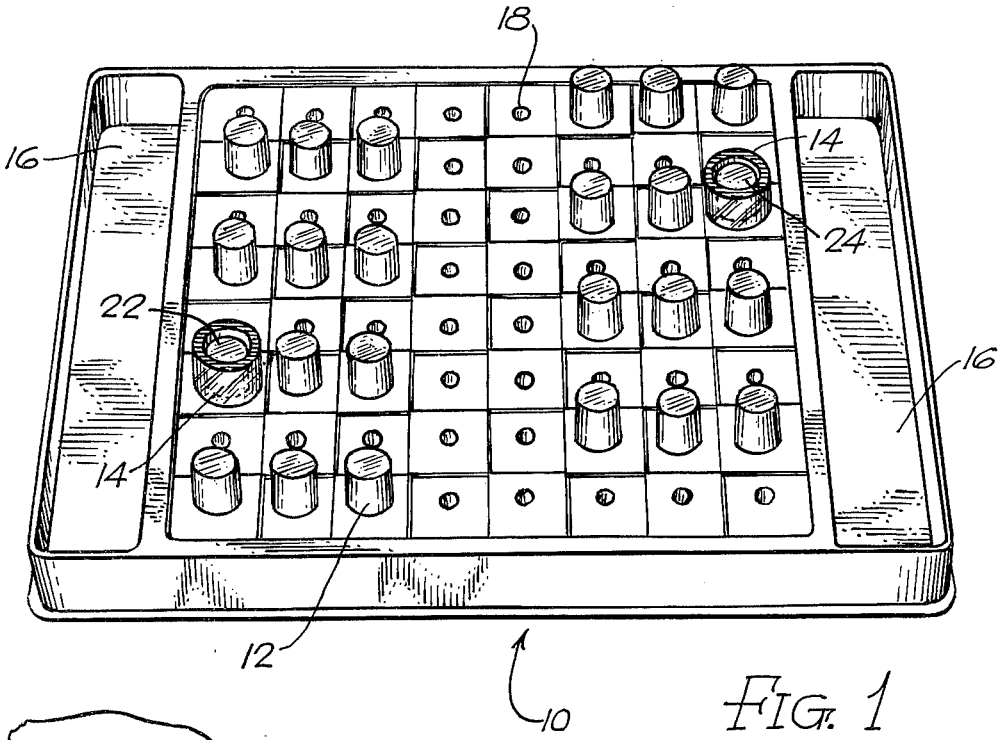
FIG. 1 is a perspective view of the game board with the courier pegs and the key markers in their initial positions.
Figure 4:
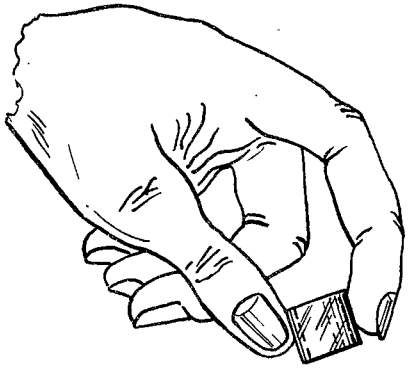
FIG. 4 is an illustration of the manner in which the key markers are moved.
Figure 3:
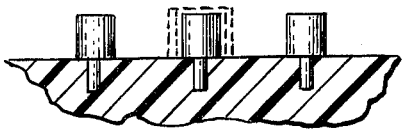
FIG. 3 is a sectional view through the game board illustrating the manner in which the courier pegs are received in the game board apertures and in which the key markers fit over the courier pegs.
Figure 3:
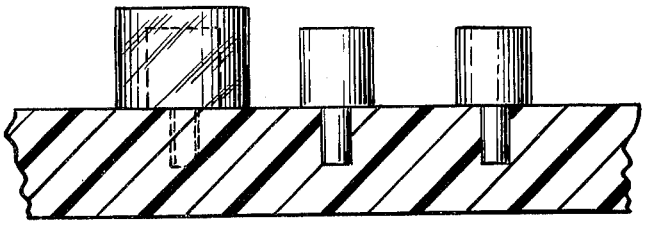
Figure 2:
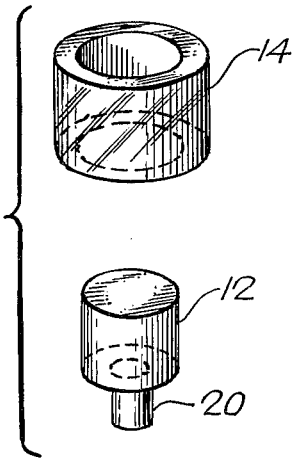
FIG. 2 is a perspective view of the key marker and a courier peg.

Referring to the drawings, it will be seen that the invention comprises a game board 10, a set of twenty-four courier pegs 12, and two key markers 14. The game board is preferably formed of one piece and is desirably plastic. At either end of the game board is a recess 16 for receiving pieces which have been jumped and removed from the game. The board 10 is arranged in an eight by eight square configuration in the manner of a standard checkerboard. However, the adjacent squares need not be of different colors since ordinary checker rules do not apply. Centrally located in each checker square is an aperture 18 for receiving one of the courier pegs 12 therein.

Each courier peg 12 is preferably a solid cylinder of a first diameter having a portion extending downwardly therefrom of a second and smaller diameter. This downwardly extending portion 20 has a diameter slightly smaller than the diameter of aperture 18. The extension 20 in conjunction with aperture 18 prevents sliding of the pegs when the key marker 14 is placed on and removed therefrom. The twenty-four courier pegs are provided in two sets of twelve each. Each set is of a different color as, for example, black and red. As indicated in FIG. 1, at the start of a game the courier pegs are arranged in a normal checkers arrangement with, for example, the red pieces on the left and the black pieces on the right. The pegs may have geometric shapes as desired.

The key markers 14 are hollow cylindrical structures which may be transparent or opaque as desired. Further, the key markers preferably are each of a different color to distinguish one from the other. The key marker must be of a diameter sufficiently large that it will fit over the courier pegs. At the start of the game each key marker is placed over any one of the back row courier pegs as, for example, pegs 22 and 24 in FIG. 1. The markers may have other hollow geometric shapes.

The object of the game is to move the key marker 14 from the one side of the board to the opposite side of the board without having it jumped by the opponent's courier pegs and before the opponent gets his key marker from the starting position to the opposite side of the board. The key markers 14 may not move onto an empty checker square but can only occupy a square which has a courier peg 12 thereon. The key marker can move to a square occupied by a courier peg of either color and thus, for example, the key marker for the red side can move onto an adjacent square occupied by a black courier peg.

The courier pegs themselves may be moved in a manner similar to a standard checker piece except that two degrees of forward movement are possible. The courier pegs can move diagonally forward or straight forward, the latter move being prohibited in standard checkers. When courier pieces of different colors are on adjacent squares, one peg may be captured by an opposing peg by jumping straight ahead or diagonally onto an open square. Such a capture or jump move may be over a courier peg on which the opponent's key marker is located. In that case, the game ends, since the opponent's key marker has been captured. In the event that neither side succeeds in jumping the other's key marker, the game is ended when the first player successfully moves his key marker to the opposite side of the board.

A unique feature of the game is that the key markers 14 may be moved onto the opponent's courier pegs and thereby be safe from attack since an opponent may not jump his own piece to capture a key marker.

From the foregoing it will be appreciated that a unique variation on the standard game of checkers has been provided. The courier pegs constitute a modified checker which have the additional function of serving as a step stone for the key markers. If there is a rapid elimination of courier pegs, it is possible for a key marker to become stranded at a remote location on the checkerboard. Since there are no kings in this game, once a courier peg has moved all the way across the board, it must remain there since it may not move in the reverse direction. If the players are sufficiently skillful, a tie game may result if the players are careful enough to prevent adequate stepping stones for their opponent to get his key marker all the way across the board.

While I have shown and described embodiments of this invention in some detail, it will be understood that this description and the accompanying illustrations are offered merely by way of example, and that the invention is to be limited in scope only by the appended claims.

I claim:

1. A board game for competition between two players comprising a. a playing surface having an eight by eight array of playing squares including an aperture through the surface provided at the center of each square, b. two sets of pegs, each set of a different color, each peg including an extension depending downwardly therefrom and dimensioned to be received in said apertures to prevent sliding movement of said pegs on said playing surface.

c. key marker means consisting of a single key marker for each set of pegs, said markers being cylinders having a hollow central portion of a dimension sufficient to be placed over said pegs, whereby each player attempts to be first to move his key marker one square at a time from one side of the playing surface to the other side, occupying only squares which have pegs located thereon.

2. The game according to claim 1, wherein said playing surface has side channels for receiving pegs which are removed from the playing surface.

3. The game according to claim 1, wherein each set of pegs consists of twelve pegs of a selected color.

4. The game according to claim 1, wherein said pegs comprise cylinders having a first diameter, said extension comprising a cylinder of a second diameter, smaller than said first diameter, said key markers having a diameter sufficiently greater than said first diameter of said pegs to be placed thereover.

5. The game according to claim 1, wherein said key markers are translucent.

6. The game according to claim 1, wherein said key markers are each of a different color.

* * * * *